US009458792B2

(12) United States Patent
Ueda et al.

(10) Patent No.: US 9,458,792 B2
(45) Date of Patent: Oct. 4, 2016

(54) EXHAUST HEAT RECOVERY DEVICE

(71) Applicant: DENSO CORPORATION, Kariya, Aichi-pref. (JP)

(72) Inventors: Kenta Ueda, Okazaki (JP); Yasutoshi Yamanaka, Kariya (JP); Yuhei Kunikata, Kariya (JP); Yuuki Mukoubara, Kariya (JP); Isao Tamada, Nagoya (JP)

(73) Assignee: DENSO CORPORATION, Kariya, Aichi-pref (JP)

( * ) Notice: Subject to any disclaimer, the term of this patent is extended or adjusted under 35 U.S.C. 154(b) by 0 days.

(21) Appl. No.: 14/420,296

(22) PCT Filed: Aug. 1, 2013

(86) PCT No.: PCT/JP2013/004662

§ 371 (c)(1),
(2) Date: Feb. 6, 2015

(87) PCT Pub. No.: WO2014/024437

PCT Pub. Date: Feb. 13, 2014

(65) Prior Publication Data

US 2015/0226154 A1 Aug. 13, 2015

(30) Foreign Application Priority Data

Aug. 7, 2012 (JP) ..... 2012-175156
Mar. 28, 2013 (JP) ..... 2013-068046

(51) Int. Cl.
*F02G 5/02* (2006.01)
*F01K 23/10* (2006.01)
(Continued)

(52) U.S. Cl.
CPC . *F02G 5/02* (2013.01); *F01K 3/16* (2013.01); *F01K 9/00* (2013.01); *F01K 11/00* (2013.01); *F01K 23/065* (2013.01); *F01K 23/10* (2013.01)

(58) Field of Classification Search
CPC ..... F01K 3/16; F01K 9/00; F01K 11/00; F01K 23/10; F01K 23/065; F02G 5/02
See application file for complete search history.

(56) References Cited

U.S. PATENT DOCUMENTS 4,489,777 A * 12/1984 Del Bagno ..... F28D 15/046 165/104.26
4,621,681 A * 11/1986 Grover ..... F22B 1/165 122/33

(Continued)

FOREIGN PATENT DOCUMENTS

JP S5579992 A 6/1980
JP S63247595 A 10/1988

(Continued)

OTHER PUBLICATIONS

International Search Report and Written Opinion (in Japanese with English Translation) for PCT/JP2013/004662, mailed Nov. 5, 2013; ISA/JP.

(Continued)

*Primary Examiner* — Audrey K Bradley
(74) *Attorney, Agent, or Firm* — Harness, Dickey & Pierce, P.L.C.

(57) ABSTRACT

An exhaust heat recovery device includes: a heating part for exchanging heat between a heating fluid and a working fluid; and a condensing part for exchanging heat between the working fluid evaporated by the heating part and a heated fluid to thereby condense the working fluid. The heating part has a tube in which the working fluid flows and whose upper end portion in a vertical direction is opened and whose lower end portion in the vertical direction is closed. The heating part has a storing part provided on an upper side in the vertical direction thereof, the storing part having a tube joint part to which the upper end portion in the vertical direction of the tube is joined and storing the working fluid condensed by the condensing part. The storing part has a condensed liquid holding part for holding the condensed working fluid.

20 Claims, 11 Drawing Sheets

(51) Int. Cl.

| | |
|---|---|
| ***F01K 3/16*** | (2006.01) |
| ***F01K 9/00*** | (2006.01) |
| ***F01K 11/00*** | (2006.01) |
| ***F01K 23/06*** | (2006.01) |

(56) References Cited

U.S. PATENT DOCUMENTS

| | | | | |
|---|---|---|---|---|
| 4,884,628 | A * | 12/1989 | En-Jian | F28D 15/0258 165/104.27 |
| 4,953,632 | A | 9/1990 | Sakaya et al. | |
| 2006/0231235 | A1 | 10/2006 | Yamanaka et al. | |
| 2009/0014154 | A1* | 1/2009 | Schick | F21V 29/004 165/80.3 |
| 2013/0037235 | A1 | 2/2013 | Sakabe et al. | |

FOREIGN PATENT DOCUMENTS

| | | | |
|---|---|---|---|
| JP | H01150413 | A | 6/1989 |
| JP | 55-085891 | | 6/1990 |
| JP | H0552491 | A | 3/1993 |
| JP | H07120179 | A | 5/1995 |
| JP | H08204075 | A | 8/1996 |
| JP | H09152287 | A | 6/1997 |
| JP | H11-257882 | | 9/1999 |
| JP | 2006292337 | A | 10/2006 |
| JP | 2006313056 | A | 11/2006 |
| JP | 2006317013 | A | 11/2006 |
| JP | 2007155246 | A | 6/2007 |
| JP | 2007-278623 | | 10/2007 |
| JP | 2007332857 | A | 12/2007 |
| JP | 2008121909 | A | 5/2008 |
| JP | 2011169514 | A | 9/2011 |
| JP | 2012215365 | A | 11/2012 |

OTHER PUBLICATIONS

Office Action mailed Aug. 31, 2015 in the corresponding CN application No. 201380041651.9 (in Chinese with English translation).

* cited by examiner

EXHAUST HEAT RECOVERY DEVICE

CROSS REFERENCE TO RELATED APPLICATIONS

This application is a U.S. National Phase Application under 35 U.S.C. 371 of International Application No. PCT/JP2013/004662 filed on Aug. 1, 2013 and published in Japanese as WO 2014/024437 on Feb. 13, 2014. This application is based on and claims the benefit of priority from Japanese Patent Application No. 2012-175156 filed on Aug. 7, 2012 and Japanese Patent Application No. 2013-68046 filed on Mar. 28, 2013. The entire disclosures of all of the above applications are incorporated herein by reference.

TECHNICAL FIELD

The present disclosure relates to an exhaust heat recovery device used for a vehicle such as an automobile.

BACKGROUND ART

There has been proposed an exhaust heat recovery device for recovering heat acquired by an exhaust gas of an automobile and for utilizing the heat for accelerating the warming up of an engine (for example, see patent document 1). This exhaust heat recovery device has a heating part for exchanging heat between the exhaust gas and a working fluid enclosed in the device and a condensing part for exchanging heat between the working fluid and a cooling water of the engine.

PRIOR ART DOCUMENT

Patent Document

Patent Document 1: JP2007-332857A

By the way, in the exhaust heat recovery device described in the patent document 1 described above, a structure such that a tube in which the working fluid flow is coupled to a header at upper and lower end portions thereof is employed as the heating part. Hence, a difference in linear expansion developed by a rapid temperature change (100 to 900° C.) in the exhaust gas may cause a thermal strain, which may result in breaking a portion in which the tube is fixed in the header.

SUMMARY OF INVENTION

The present disclosure addresses the above issues. Thus, it is an objective of the present disclosure to provide an exhaust heat recovery device that can be restricted from being broken by a thermal strain.

To achieve the objective of the present disclosure, an exhaust heat recovery device in one aspect of the present disclosure includes a heating part, a condensing part, and a storing part. The heating part exchanges heat between heating fluid and working fluid, which is enclosed in the heating part and is capable of being evaporated and condensed, so as to evaporate the working fluid. The heating part includes a tube through which the working fluid flows. An upper end portion of the tube in a vertical direction opens. A lower end portion of the tube in the vertical direction is closed. The condensing part exchanges heat between the working fluid evaporated by the heating part and heated fluid so as to condense the working fluid. The storing part is provided on an upper side of the heating part in the vertical direction and stores the working fluid condensed by the condensing part. The storing part includes a tube joint part that is joined to the upper end portion of the tube, and a condensed liquid holding part that holds the working fluid condensed by the condensing part.

According to the present disclosure, only the upper side end portion of the tube is joined to the tube joint part and the tube is not constrained at a portion other than the upper side end portion thereof. Therefore, it is possible to restrict a thermal strain from being caused by a difference in linear expansion developed by a rapid temperature change in the heating fluid and hence to restrain a portion in which the tube is fixed in the tube joint part from being broken.

Further, the exhaust heat recovery device is provided with the storing part for storing the working fluid condensed by the condensing part, so the condensed working fluid is brought into contact with the tube joint part to thereby restrict the temperature of the tube joint part from being increased. Further, in the storing part is arranged the condensed liquid holding part for holding the working fluid condensed by the condensing part, so the condensed working fluid can be wetly spread over the entire storing part, that is, over the entire surface of the tube joint part. Hence, even in the case where the temperature of the heating fluid is rapidly increased, a temperature increase in the tube joint part can be restricted, which hence can restrict a thermal strain from being caused and can reliably restrict a portion in which the tube is fixed in the tube joint part from being broken.

In another mode of the present disclosure, the condensed liquid holding part may be eliminated from the exhaust heat recovery device of one mode described above.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

Figure 1:
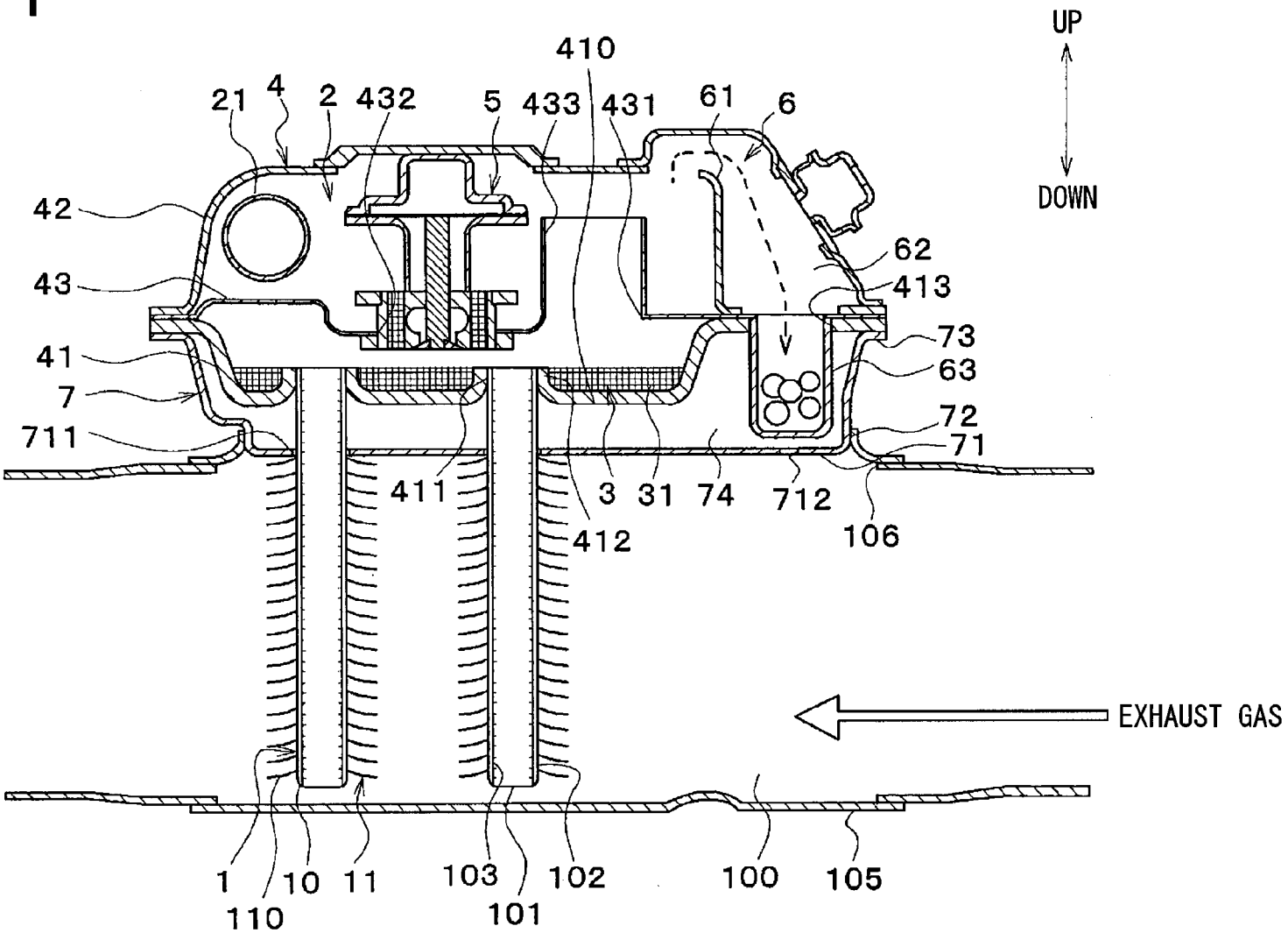
FIG. 1 is a schematic section view to show a sectional construction of an exhaust heat recovery device according to a first embodiment.
Figure 2:
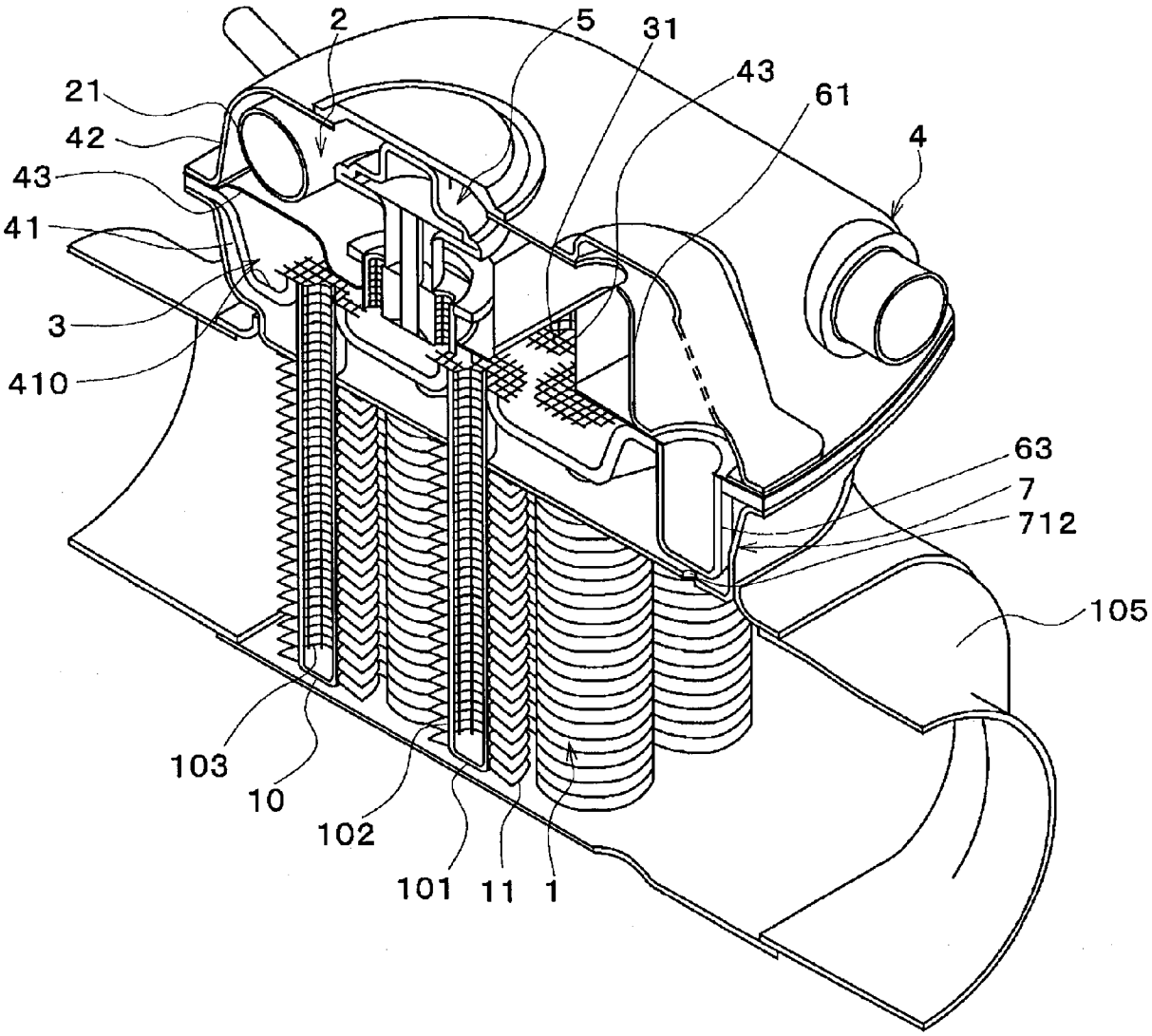
FIG. 2 is an exploded perspective view to show the exhaust heat recovery device according to the first embodiment.

Hereinafter, embodiments will be described on the basis of the drawings. Here, same parts or equivalent parts in the respective embodiments to be described below will be denoted by the same reference characters in the drawings.

First Embodiment

A first embodiment will be described on the basis of FIG. 1 to FIG. 5. An exhaust heat recovery device of the present embodiment recovers an exhaust heat of an exhaust gas from an exhaust system of an engine (internal combustion engine) of a vehicle and uses the exhaust heat for warming up the engine. Here, the direction of an arrow directed up and down in FIG. 1 shows a direction of the state in which the exhaust heat recovery device is mounted in the vehicle. Further, in FIG. 2, for the purpose of making the figure clear, a part of a hydrogen removing device to be described later will be omitted.

As shown in FIG. 1, the exhaust heat recovery device of the present embodiment is provided with a heating part 1, a condensing part 2, and a storing part 3. The heating part 1 is provided in an exhaust passage 100 in which the exhaust gas of the engine flows. Further, the heating part 1 exchanges heat between a working fluid enclosed in the heating part 1 and the exhaust gas to thereby evaporate the working fluid. Here, the exhaust gas corresponds to a heating fluid of the preset disclosure.

The condensing part 2 is provided on the outside of the exhaust passage 100. The condensing part 2 exchanges heat between the working fluid evaporated by the heating part 1 and the cooling water of the engine to thereby condense the working fluid. Here, the cooling water corresponds to a heated fluid of the present disclosure.

The storing part 3 is provided on the upper side in a vertical direction of the heating part and on the outside of the exhaust passage 100. The storing part 3 stores the working fluid condensed by the condensing part 2 and the working fluid condensed by the condensing part 2 flows into the heating part 1 through the storing part 3. In the present embodiment, the heating part 1, the storing part 3, and the condensing part 2 are arranged in this order toward an upper side in the vertical direction.

The heating part 1 has a plurality of tubes 10 in which the working fluid flows and which have their upper end portions in the vertical direction opened and which have their lower end portions in the vertical direction closed. Of each of the tubes 10, a most portion on the lower side (in the present embodiment, a portion of approximately 80% from a lower end portion thereof) is arranged in the exhaust passage 100 and a portion on the upper side (in the present embodiment, a portion of approximately 20% from an upper end portion thereof) is arranged on the outside of the exhaust passage 100.

Specifically, an exhaust duct 105 forming the exhaust passage 100 has a through hole 106 formed in an upper face thereof and the tubes 10 are inserted into the exhaust passage 100 from an upper side of the through hole 106, whereby the tubes 10 are arranged in the exhaust passage 100.

The upper end portions of the plurality of tubes 10 are joined to a core plate 41 of the storing part 3 to be described later, respectively. The plurality of tubes 10 are not connected to each other except for the portions in which the tubes 10 are joined to the core plate 41.

In the present embodiment, each of the tubes 10 is formed in the shape of a hollow cylinder having a closed end and has a bottom portion 101 arranged on the lower side. Further, a corner portion formed by the bottom portion 101 and a side portion 102 of the tube 10 is formed in the shape of a circular arc protruding to the outside of the tube 10. In other words, the corner portion formed by the bottom portion 101 and the side portion 102 of the tube 10 are chamfered in the shape of the circular arc. Further, a wick 103 made of a metal mesh is provided on an inner surface of the tube 10. The wick 103 is formed in the shape of a net and is arranged on the entire circumference of the inner surface of the tube 10.

The side portion 102 of a portion arranged in the exhaust passage 100 in the tube 10 has a plurality of fins 11 joined thereto, the plurality of fins 11 accelerating a heat conduction between the exhaust gas and the working fluid. The fins 11 jointed to the plurality of tubes 10 are not connected to each other.

In the present embodiment, each of the fins 11 is formed in the shape of an umbrella. That is, each of the fins 11 has a curved surface 110 shaped like a circular arc in which a portion closer to the lower side is longer in distance from the tube 10 and in which is protruded to the lower side. When the fin 11 is viewed from a longitudinal direction of the tube 10 (in the vertical direction), the fin is formed in the shape of a ring.

On the upper side of the heating part 1, there is provided a tank part 4 in which the working fluid flows. The tank part 4 has the core plate 41 as a tube joint part which has an upper end side of the tube 10 joined thereto, a tank main body part 42 which constructs a tank interior space together with the core plate 41, and a partition plate 43 which is provided between the core plate 41 and the tank main body part 42 and which partitions the tank interior space into two portions in the vertical direction.

Of the tank interior space of the tank part 4, a space formed by the core plate 41 and the partition plate 43 constructs the storing part 3 and a space formed by the tank main body part 42 and the partition plate 43 constructs the condensing part 2.

The core plate 41 has a tube joint face 410 formed in the shape of a flat plane. Tube joint face 410 has a plurality of communication holes 411 each of which has each of the tubes 10 inserted thereinto. Each of the communication holes 411 of the core plate 41 has a rib 412 formed at the opening edge portion thereof, the rib 412 protruding to the upper side from the tube joint face 410. The rib 412 is formed when the communication hole 411 is formed in the core plate 41 by burring.

An upper end portion of the tube 10 is arranged on the upper side than the tube joint face 410, that is, a lower end face in the vertical direction of the core plate 41. For this reason, the core plate 41 can store the condensed working fluid on the tube joint face 410 thereof.

The storing part 3 is provided with a wick 31 as a condensed liquid holding part for holding the condensed working fluid by a capillary force. The wick 31 is a part which is made of a metal mesh and which can temporarily hold the condensed working fluid in its apertures.

In the condensing part 2 is arranged a cooling water pipe 21 in which the cooling water of the engine flows. The condensing part 2 is constructed in such a way that heat is exchanged between the cooling water flowing in the cooling water pipe 21 and the working fluid flowing outside the cooling water pipe 21. The working fluid which is cooled and condensed at the surface of the cooling water pipe 21 is made to drop to the lower side of the condensing part 2. In the present embodiment is employed a pipe which is formed in the shape of a letter U and which is made of stainless steel and the section of which is formed in a circular shape.

The partition plate 43 of the tank part 4 has a first through hole 431 and a second through hole 432 formed therein, each of the first through hole 431 and the second through hole 432 being formed in a circular shape. The storing part 3 and the condensing part 2 communicate with each other via the two through holes 431, 432. On an outer circumferential edge portion of the first through hole 431 is provided a wall part 433 extending to an upper side in the vertical direction. The wall part 433 can make the working fluid (water vapor), which flows out of the storing part 3 and is in the state of gas, flow into the condensing part 2 from the upper side in the vertical direction of the condensing part 2. The second through hole 432 is provided with a valve 5 which opens or closes a passage of the working fluid flowing into the storing part 3 from the condensing part 2.

Figure 3:
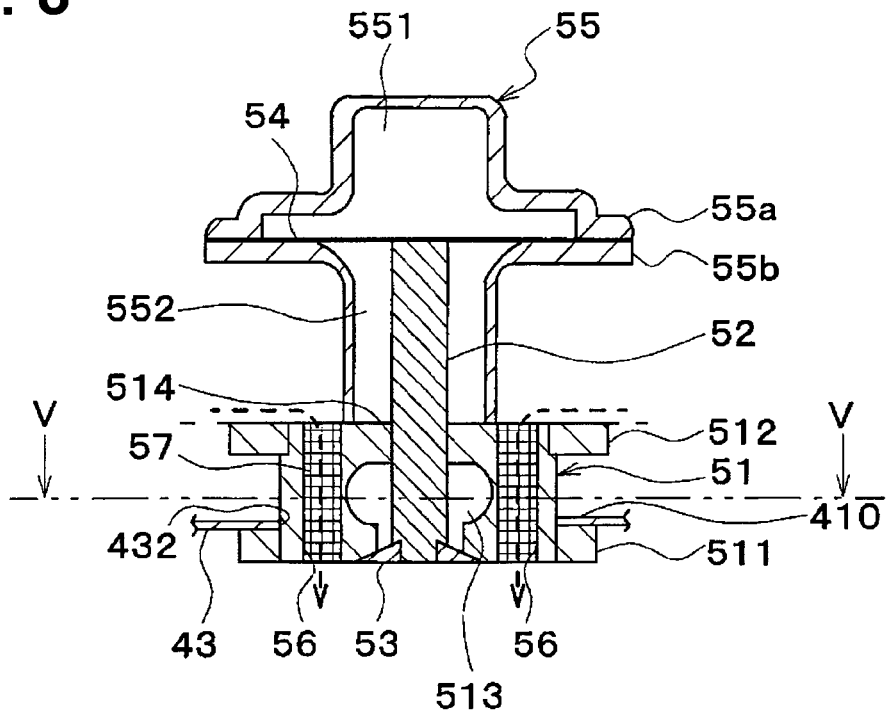
FIG. 3 is a section view to show a state in which a valve 5 in the first embodiment is closed.
Figure 4:
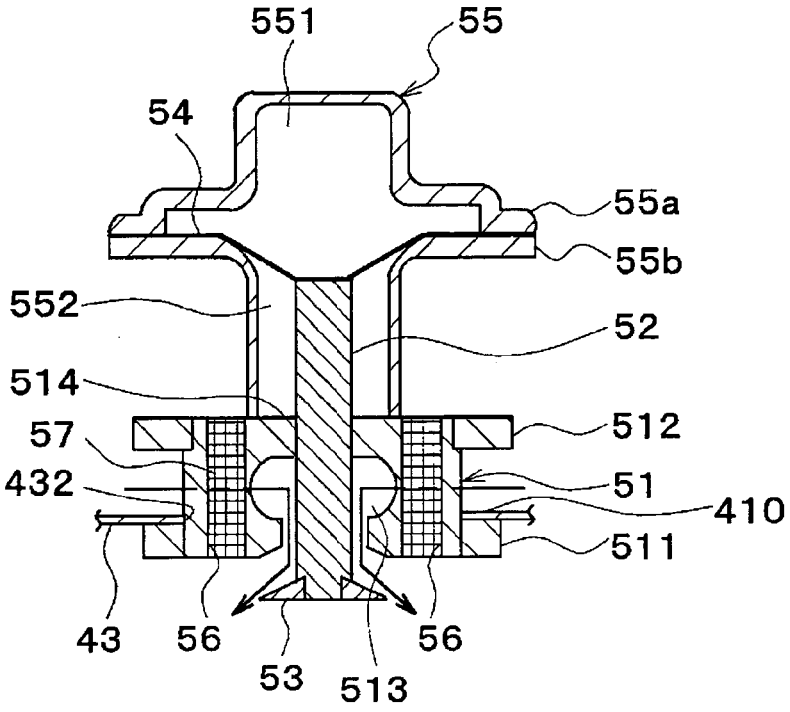
FIG. 4 is a section view to show a state in which the valve 5 in the first embodiment is opened.
Figure 5:
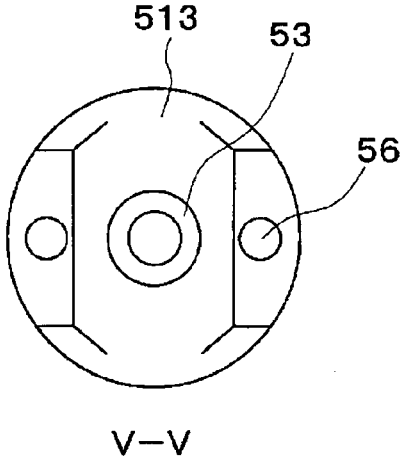
FIG. 5 is a section view taken on a line V-V in FIG. 3.

As shown in FIG. 3 to FIG. 5, the valve 5 has a cylindrical base part 51 which is fitted in the second through hole 432. The base part 51 has flanges 511, 512 provided at a lower side end portion and an upper side end portion in the vertical direction thereof.

An upper side face of the flange 511 on the lower end side of the base part 51 is joined to a face on the lower side of the partition plate 43. A clearance is formed between the flange 512 on the upper end side of the base part 51 and the partition plate 43, so the flange 512 is not in contact with the partition plate 43.

In the base part 51 is formed a working fluid passage 513 which makes the condensing part 2 communicate with the storing part 3. The working fluid passage 513 is open at both of a portion, which is between the flange 512 and the partition plate 43 on the side face of the base part 51, and a face on the lower side of the base part 51.

In the base part 51 is formed a through hole 514 through which a bar-shaped member 52 extending in the vertical direction passes. To the lower end side of the bar-shape member 52 is connected a valve body 53 for opening and closing the working fluid passage 513. The valve body 53 is arranged in such a way as to be put into contact with a lower end face of the base part 51. An upper end side of the bar-shaped member 52 abuts on a diaphragm 54 formed in the shape of a thin film. The valve body 53 is pressed in a direction to close the valve 5 (in an upper direction in FIG. 1) by the diaphragm 54.

The diaphragm 54 is arranged on the upper side of the base part 51. The diaphragm 54 is formed in the shape of a circular disk. The diaphragm 54 is arranged in a diaphragm case 55 and partitions a space in the diaphragm case 55 into a first pressure chamber 551 on the upper side and a second pressure chamber 552 on the lower side.

The diaphragm case 55 is formed of a first diaphragm case 55*a* and a second diaphragm case 55*b*, each of which is made by pressing a metal plate having a comparatively thin thickness into a predetermined shape. The first and second diaphragm cases 55*a*, 55*b* are crimped with an outer circumferential face of the diaphragm 54 sandwiched between them, thereby being integrated with each other. Further, the second diaphragm case 55*b* is joined to an upper end of the base part 51, whereby the entire diaphragm case 55 is integrally combined with the base part 51.

The first pressure chamber 551 formed of the diaphragm 54 and the first diaphragm case 55*a* is always made to communicate with the atmosphere through a through hole, which is not shown, or is always sealed in vacuum, thereby being always held at a constant pressure, so the interior of the first pressure chamber 551 is held at the same pressure as the atmospheric pressure. On the other hand, the second pressure chamber 552 formed of the diaphragm 54 and the second diaphragm case 55*b* is always made to communicate with the condensing part 2 through a through hole, which is not shown, so the interior of the second pressure chamber 552 is held at the same pressure as the condensing part 2.

By the construction like this, the valve body 53 is driven by the displacement of the diaphragm 54, which is caused by a pressure difference between the first pressure chamber 551 and the second pressure chamber 552, an opening area of the working fluid passage 513 is changed, that is, the working fluid passage 513 is opened or closed. Specifically, as shown in FIG. 3, in the case where the pressure in the second pressure chamber 552 is larger than the pressure in the first pressure chamber 551, the valve body 53 is pressed onto a lower end face of the base part 51, which brings about a state where the working fluid passage 513 is closed, that is, a state where the valve 5 is closed.

On the other hand, as shown in FIG. 4, in the case where the pressure in the first pressure chamber 551 is larger than the pressure in the second pressure chamber 552, the valve body 53 is moved in a direction to separate from the lower end face of the base part 51, which brings about a state where the working fluid passage 51 is opened, that is, a state where the valve 5 is opened. When the valve 5 is opened, as shown by large solid arrows in FIG. 4, the condensed working fluid flows through the working fluid passage 513 from a side face of the base part 51 and flows out to the storing part 3 from the bottom face of the base part 51.

In the base part 51 is formed a bypass hole (bypass passage) 56 for making an upper end side of the base part 51 communicate with a lower end side of the base part 51. In this way, when the valve 5 is closed, the condensed working fluid is held in the condensing part 2, but in the case where a water level of the condensed working fluid is higher than an upper face of the flange 512 (see a portion shown by broken lines in FIG. 3), as shown by the large broken arrows in FIG. 3, the working fluid can be made to flow out to the storing part 3 through the bypass hole 56.

At this time, since the flange 512 is provided on the upper end portion of the base part 51, in the case where the water level of the condensed working fluid is not higher than the upper face of the flange 512, it is possible to restrict the working fluid from flowing into the bypass hole 56 by vibration.

In the present embodiment, a bar-shaped mesh 57 is inserted into the bypass hole 56. In this way, the flow rate of the working fluid flowing through the bypass hole 56 can be stabilized. Then, by adjusting the dimensions of the mesh 57, a desired flow rate of working fluid can be acquired.

By the way, in the present embodiment, water is employed as the working fluid and the exhaust heat recovery device is constructed of a chrome-based stainless steel. For this reason, when the exhaust heat recovery device is brought into a high temperature higher than approximately 600° C., the following chemical reaction 1 is caused to generate a hydrogen gas.

$$2Fe+2Cr+3H_2O \rightarrow Fe_2O_3+Cr_2O_3+3H_2 \quad \text{(Chemical formula 1)}$$

For this reason, the exhaust heat recovery device is provided with a hydrogen removing device 6 for removing the hydrogen gas generated at the high temperature. In the present embodiment, as shown in FIG. 1, the hydrogen removing device 6 is connected to an upper end portion of the tank part 4 and is constructed in such a way that the hydrogen gas flows in from the upper end portion of the condensing part 2.

Specifically, in the condensing part 2 is provided a partition wall part 61 extending to an upper side from an upper face of the partition plate 43. A clearance is formed between an upper end portion of the partition wall part 61 and the tank main body 42. In the present embodiment, the valve 5, the first through hole 431, the partition wall part 61 are arranged in this order.

On a side opposite to the first through hole 431 of the partition wall part 61 in the condensing part 2 is formed a hydrogen gas introduction passage 62 in which the hydrogen gas generated at the high temperature flows. In a portion corresponding to the hydrogen gas introduction passage 62 in the core plate 41 is formed a through hole 413. To the through hole 413 is joined an upper end portion of a copper oxide receiving part 63 which is formed in the shape of a cylinder which is open only at an upper end thereof. In the copper oxide receiving part 63 is received granular copper oxide (II). The metal oxide receiving part 63 communicates with the condensing part 2 through the hydrogen gas introduction passage 62.

With this construction, as shown by a broken arrow in FIG. 1, the hydrogen gas flowing out of the upper end portion of the condensing part 2 flows through the hydrogen gas introduction passage 62 and flows into the copper oxide receiving part 63. Then, in the copper oxide receiving part 63, the following chemical reaction 2 is caused.

$$3CuO+3H_2 \rightarrow 3Cu+3H_2O \quad \text{(Chemical formula 2)}$$

In this way, in the copper oxide receiving part 63, the hydrogen reacts with the copper oxide (II) to generate copper and water, so the hydrogen can be removed.

By the way, the exhaust heat recovery device is provided with a heat guard 7 as a heat conduction limiting member for limiting a heat conduction from the exhaust gas flowing through the exhaust passage 100 of the heating part 1 to the working fluid stored in the storing part 3. The heat guard 7 is arranged between the heating part 1 and the storing part 3.

In more detail, a section when the heat guard 7 is viewed from a direction orthogonal to the vertical direction is formed nearly in the shape of a letter C which is open on the upper side. That is, the heat guard 7 is constructed of a bottom part 71 formed in a flat plane perpendicular to the vertical direction, a wall part 72 bent in nearly perpendicularly from the outer circumferential portion of the bottom part 71 and extended to the upper side, and a flange part 73 bent nearly perpendicularly from the wall part 72 and extended in a direction perpendicular to the vertical direction.

The flange part 73 of the heat guard 7 is joined to the outer circumferential edge portion of the core plate 41. The heat guard 7 is in contact with the core plate 41 only at the flange part 73 and a space (hereinafter also referred to as a heat guard space 74) is formed among the bottom part 71 and the core plate 41 and the core plate 41.

In the bottom part 71 of the heat guard 7 are formed tube through holes 711 into which the tubes 10 are inserted respectively. An inside diameter of the tube through hole 711 is formed in a slightly larger size than an outer diameter of the tube 10. For this reason, the tube 10 is not in contact with the tube through hole 711 in the state where the tube 10 is inserted into the tube through hole 711.

Further, the bottom part 71 of the heat guard 7 is formed in a shape corresponding to the through hole 106 of the exhaust duct 105, that is, in a shape capable of closing the through hole 106. The heat guard 7 is joined to the exhaust duct 105 in the state where the bottom part 71 closes the through hole 106 of the exhaust duct 105. Hence, it can be also said that the exhaust passage 100 is formed of the exhaust duct 105 and the bottom part 71 of the heat guard 7.

Further, a heating through hole 712 is formed at a portion opposite to the copper oxide receiving part 63 in the bottom part 71 of the heat guard 7. In this way, the exhaust gas flowing through the exhaust passage 100 flows into the heat guard space 74 through the heating through hole 712. At this time, the copper oxide receiving part 63 can be heated by the heat acquired by the exhaust gas. In this regard, the exhaust gas flowing through the exhaust passage 100 flows into the heat guard space 74 also from the tube through hole 711.

Since the heat guard 7 is provided with the heating through hole 712 and the tube through hole 711, the exhaust gas flows not only through the exhaust passage 100 but also through the heat guard space 74. Hence, the exhaust passage 100 and the heat guard space 74 correspond to a heating fluid passage of the present disclosure.

Next, the action of the exhaust heat recovery device of the present embodiment will be described. At the time of heat recovery when the exhaust heat recovery device recovers the heat of the exhaust gas, the valve 5 is opened. At this time, in the tube 10 of the heating part 1, the working fluid is heated by the exhaust gas and hence is evaporated, thereby flowing out to the storing part 3 from the top end portion of the tube 10. The vapor of the working fluid flowing out of the top end portion of the tube 10 flows into the condensing part 2 through the storing part 3 and the first through hole 431 of the partition plate 43. The vapor of the working fluid flowing into the condensing part 2 exchanges heat with the cooling water flowing in the cooling water pipe 21 and hence is condensed on the surface of the cooling water pipe 21, thereby being brought into liquid and dropped on the partition plate 43.

The liquid working fluid dropped on the partition plate 43 flows through the working fluid passage 513 in the valve 5 and is returned onto the core plate 41 of the storing part 3. The liquid working fluid flowing into the storing part 3 is stored on the core plate 41. Then, when the water level of the working fluid becomes higher than the top end portion of the rib 412, the working fluid again flows into the tube 10 from the top end portion of the tube 10.

On the other hand, at the time of heat interruption when the exhaust heat recovery device does not recover the heat of the exhaust gas, the valve 5 is closed. At this time, the working fluid condensed on the surface of the cooling water pipe 21 remains on the partition plate 43. Then, when the water level of the working fluid remaining on the partition plate 43 becomes higher than the upper face of the flange 512, the working fluid flows into the storing part 3 through the bypass hole 56.

In the exhaust heat recovery device of the present embodiment, only the upper side end portion of the tube 10 is joined to the core plate 41 and the tube 10 is not constrained at a portion other than the upper side end portion thereof. In this way, it is possible to restrict a portion in which the tube 10 is rooted in the core plate 41 from being broken by a thermal strain developed by a difference in linear expansion caused by a rapid temperature change in the exhaust gas.

Further, the upper end portion of the tube 10 is arranged on the upper side than the tube joint face 410 of the core plate 41 and there is provided the storing part 3 for storing the working fluid condensed in the condensing part 2, so a specified amount of liquid working fluid can be made to exist on the tube joint face 410 of the core plate 41. In this way, the condensed working fluid can be brought into contact with the core plate 41 to thereby restrict a temperature increase in the core plate 41. Still further, since the exhaust heat recovery device is provided the storing part 3, when the exhaust heat recovery device usually recovers the exhaust heat, the exhaust heat recovery device can distribute the working fluid uniformly to the respective tubes 10 irrespective of the position in which the valve 5 is provided.

Still further, since the wick 31 which holds the working fluid condensed in the condensing part 2 by the capillary force is arranged in the storing part 3, the liquid working fluid can be wetly spread on the entire surface of the core plate 41. Hence, even in the case where the temperature of the exhaust gas is rapidly increased, a temperature increase in the core plate 41 can be restricted, which hence makes it possible to restrict a thermal strain from being developed and to reliably restrict the portion in which the tube 10 is fixed to the core plate 41 from being broken by the thermal strain.

Still further, since the storing part 3 has the wick 31 arranged therein, the wick 31 can restrict the liquid working fluid existing on the core plate 41 from being moved to one side or jumped by vibration or by the inclination of the exhaust heat recovery device to thereby make the working fluid flow into the tube 10 in the state where the specified amount of working fluid does not exist on the core plate 41.

By the way, in the exhaust heat recovery device having the valve 5 like the present embodiment, when load is high and a cooling water temperature is high, the valve 5 needs to be throttled to reduce the flow rate of the working fluid circulated in the exhaust heat recovery device, thereby reducing the amount of heat to be recovered. However, when the cooling water temperature is high, the amount of circulation of the working fluid might be excessively reduced by the valve 5 to thereby eliminate the working fluid from being on a part of the core plate 41 (to thereby dry out the core plate 41). In this case, a local temperature distribution will be formed on the core plate 41 and a strained amplitude, which is caused by a temperature difference between at the time when the core plate 41 is dried out and at the time when the water level of the working fluid is high, will extremely reduce the life of the exhaust heat recovery device.

In contrast to this, in the present embodiment, there is provided the bypass hole 56 which makes the working fluid condensed in the condensing part 2 bypass the valve 5 to thereby introduce the working fluid into the storing part 3. In this way, even when the valve 5 is closed, in the case where the water level of the working fluid on the partition plate 43 is higher than a given level, the working fluid can be returned to the storing part 3 through the bypass hole 56. For this reason, it is possible to always make the liquid working fluid exist on the core plate 41 and hence to restrict a local temperature distribution from being formed on the core plate 41.

Further, in the present embodiment, the heat guard 7 for restricting the heat conduction from the exhaust gas of the heating part 1 to the working fluid in the storing part 3 is provided between the heating part 1 and the storing part 3. In this way, it is possible to restrict the core plate 41 from being heated with the heat acquired by the exhaust gas to thereby increase the temperature of the core plate 41.

Still further, in the present embodiment, the fins 11 provided on the plurality of tubes 10 are constructed in such a way as not to be connected to each other. In this way, it is possible to restrict the tubes 10 from being constrained at a portion other than the upper side end portion thereof and hence to restrict a thermal strain from being developed by a difference in linear expansion caused by a rapid temperature change in the exhaust gas.

By the way, when the temperature of the tube 10 is lowered, the fins 11 joined to the tube 10 are pulled inside (to the side of the tube 10) and hence the fins are deformed. In addition, when the fins 11 are once deformed, even if the temperature of the tube 10 is made higher, the deformed fins 11 cannot be returned to their original shapes.

In contrast to this, in the present embodiment, each of the fins 11 has a curved face 110 which is protruded to the lower side and which is shaped like a circular arc. In this way, even if the temperature of the tube 10 is lowered to thereby apply a force pulling inside to the fin 11, the curved face 110 shaped like the circular arc can absorb the deformation of the fun 11 and hence can restrict the fin 11 from being deformed.

Further, in the present embodiment, the tube 10 is formed in the shape of a hollow cylinder having a closed end and a corner portion formed of the side part 102 and the bottom part 101 is formed in the shape a circular arc. In this way, it is possible to secure the pressure resistance of the tube 10 and to restrict the thermal strain from being developed in the tube 10.

By the way, like the present embodiment, the exhaust heat recovery device provided with the hydrogen removing device 6 for removing the hydrogen gas generated at the high temperature has the copper oxide receiving part 63 in which copper oxide (II) for removing the hydrogen is enclosed. Since a hydrogen removing reaction by the copper oxide (II) (see the chemical formula 2 described above) is not caused at a high temperature not less than 300° C., the copper oxide receiving part 63 is usually arranged in the heating part 1 in which the exhaust gas flows. However, under the circumstance of a high temperature not less than 600° C., an oxidation phenomenon of the stainless steel is accelerated with the copper oxide (II) as a medium, which hence presents a problem that the tube 10 of the heating part 1 is oxidized and corroded.

In contrast to this, in the present embodiment, the upper end portion of the copper oxide receiving part 63 is connected to the core plate 41 and the copper oxide receiving part 63 is arranged in the heat guard space 74 in which the exhaust gas flows. According to this, since the copper oxide receiving part 63 is arranged at the portion in which the exhaust gas flows, the copper oxide receiving part 63 can be heated with the heat acquired by the exhaust gas and hence the hydrogen removing reaction by the copper oxide (II) can be reliably caused. On the other hand, the upper end portion of the copper oxide receiving part 63 is connected to the core plate 41 which has the liquid working fluid stored on the upper face thereof and which is at a comparatively low temperature, so the copper oxide receiving part 63 can be restricted from being brought to an abnormally high temperature. Hence, it is possible to remove the hydrogen gas and to restrict the abnormal oxidization phenomenon of the stainless steel at the same time.

In particular, the copper oxide receiving part 63 is arranged in the heat guard space 74 and the heating through hole 712 is formed in the heat guard space 74 to thereby introduce the exhaust gas into the heat guard space 74, so it is possible to prevent the main stream of the exhaust gas of high temperature from directly hitting the copper oxide receiving part 63. In this way, it is possible to restrict the temperature of the copper oxide receiving part 63 from being changed by the flow rate of the exhaust gas. Hence, even when the exhaust heat recovery device is mounted in a vehicle having a large displacement, it is possible to remove the hydrogen gas and to restrict the abnormal oxidization phenomenon of the stainless steel at the same time.

Further, the present embodiment is constructed in such a way that the hydrogen gas introduction passage 62 is connected to the upper side of the condensing part 2 to thereby make the hydrogen gas flow into the hydrogen gas removing device 6 from the upper end portion of the condensing part 2. In this way, it is possible to make the hydrogen gas which is lighter than the working fluid flow into the copper oxide receiving part 63 through the hydrogen gas introduction passage 62 to thereby restrict the working fluid from flowing into the copper oxide receiving part 63.

Second Embodiment

Figure 6:
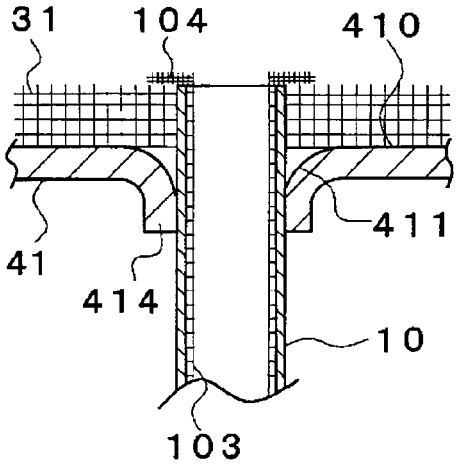
FIG. 6 is a section view to show a vicinity of a portion in which a tube 10 is fixed in a core plate in a second embodiment.

Next, a second embodiment will be described on the basis of FIG. 6. As shown in FIG. 6, in the exhaust heat recovery device of the present embodiment, the upper end portion of the tube 10 is arranged on the upper side of the core plate 41.

The communication hole 411 of the core plate 41 has a rib 414 formed on an opening edge portion thereof, the rib 414 protruding to a lower side in the vertical direction. The rib 414 is formed at the time when the communication hole 411 is formed in the core plate 41 by burring. The tube 10 has a wick 104 provided on an upper end face thereof, the wick 104 being made of metal in such a way as to connect a wick 103 arranged on an inner face of the tube 10 and a wick 31 arranged on the core plate 41.

According to the present embodiment, the wick 104 is provided on the upper end portion of the tube 10, so when the exhaust heat recovery device usually recovers the exhaust heat, the exhaust heat recovery device can suck only the working fluid overflowing from the wick 31 into the tube 10 by the wick 104. Hence, it is possible to restrict the exhaust heat recovery device from making the working fluid flow into the tube 10 more than necessary to thereby eliminate the working fluid on the core plate 41 (to thereby dry out the core plate 41).

Third Embodiment

Next, a third embodiment will be described on the basis of FIG. 7. The third embodiment is different from the second embodiment described above in the shape of the upper end portion of the tube 10.

Figure 7:
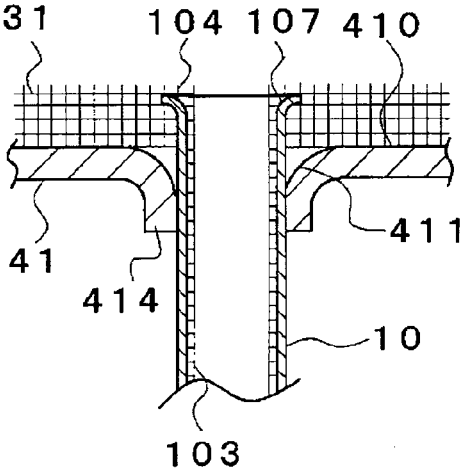
FIG. 7 is a section view to show a vicinity of a portion in which a tube 10 is fixed in a core plate in a third embodiment.

As shown in FIG. 7, the upper end portion of the tube 10 is formed in a reverse flow restricting portion 107 which is curved in the shape of a circular arc in such a way as to expand to the inside of the tube 10. Since the reverse flow restricting portion 107 is provided, in the case where the exhaust heat is not recovered, the reverse flow restricting portion 107 can restrict the condensed working fluid stored in the storing part 3 from flowing into the tube 10 by the acceleration of the vehicle or the like.

Fourth Embodiment

Next, a fourth embodiment of the present embodiment will be described on the basis of FIG. 8. The fourth embodiment is different from the first embodiment described above in that the hydrogen removing device 6 is constructed as a part separate from the tank part 4. Here, the fins 11 will be omitted in FIG. 8.

Figure 8:
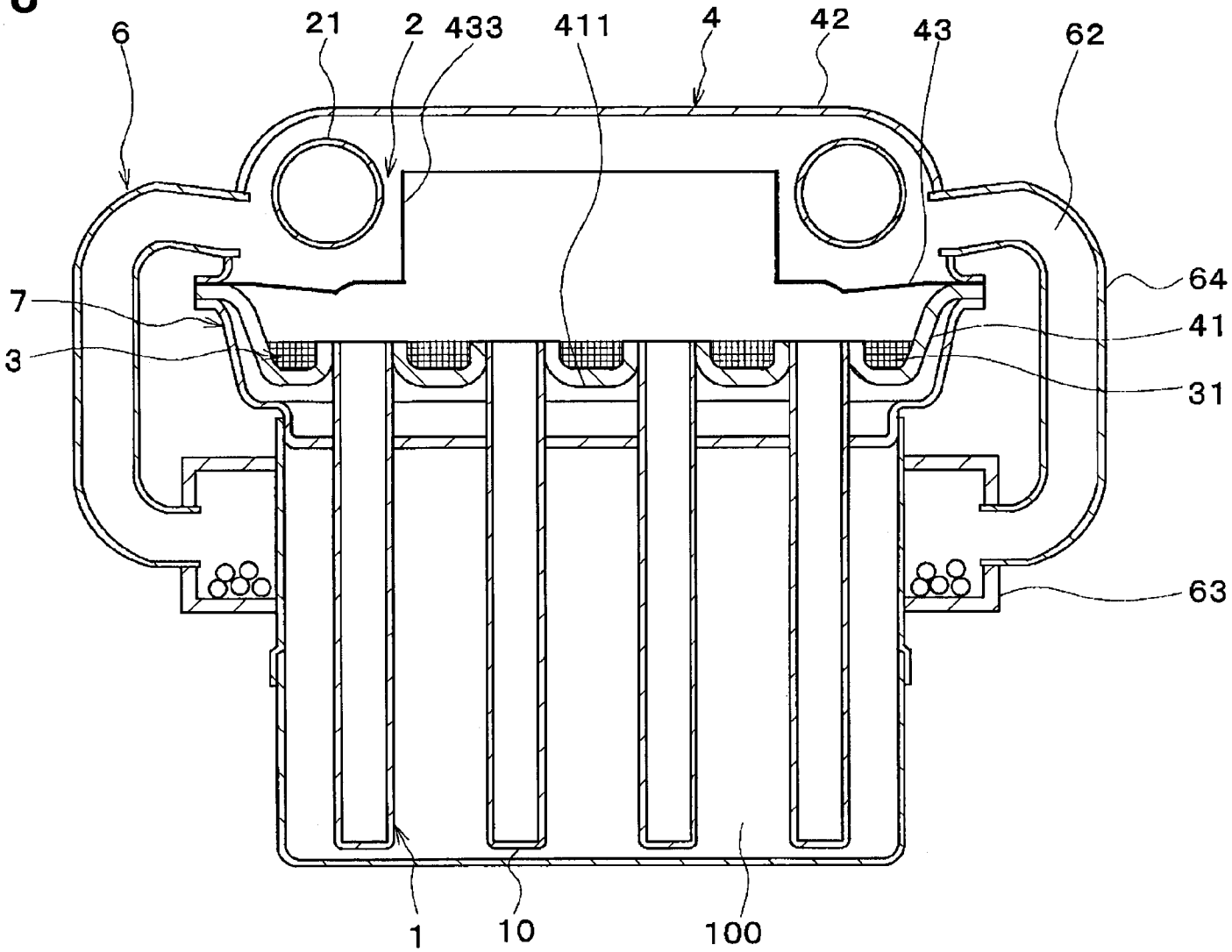
FIG. 8 is a schematic section view to show a sectional construction of an exhaust heat recovery device according to a fourth embodiment.

As shown in FIG. 8, the copper oxide receiving part 63 of the hydrogen removing device 6 is arranged on the outside of the exhaust duct 105 (on the side of the outside air). Further, one face of the copper oxide receiving part 63 is joined to an outer surface of the exhaust duct 105. In this way, a part of the copper oxide receiving part 63 is joined to the exhaust passage 100 via the exhaust duct 105. Further, of the copper oxide receiving part 63, a portion which is not in contact with the outer surface of the exhaust duct 105 is in contact with the outside air.

To the copper oxide receiving part 63 is connected one end portion of a hydrogen gas introduction pipe 64 which forms the hydrogen gas introduction passage 62. The other end portion of the hydrogen gas introduction pipe 64 is connected to the condensing part 2 of the tank part 4. In other words, the copper oxide receiving part 63 and the condensing part 2 are connected to each other via the hydrogen gas introduction pipe 64. In this way, the hydrogen gas which flows out of the condensing part 2 flows through the hydrogen gas introduction pipe 64 and flows into the copper oxide receiving part 63.

According to the present embodiment, the copper oxide receiving part 63 is arranged at a portion in contact with the exhaust passage 100 in which the exhaust gas flows, so the copper oxide receiving part 63 can be heated with the heat acquired by the exhaust gas and hence the hydrogen removing reaction by the copper oxide (II) can be reliably caused. On the other hand, a portion which is not in contact with the exhaust passage 100 in the copper oxide receiving part 63 is brought into contact with the outside air, so the copper oxide receiving part 63 can be restricted from being made abnormally high temperature. Hence, it is possible to remove the hydrogen gas and to restrict the abnormal oxidization phenomenon of the stainless steel at the same time.

Fifth Embodiment

Next, a fifth embodiment of the present embodiment will be described on the basis of FIG. 9. The fifth embodiment is different from the first embodiment described above in the construction of the fin 11.

Figure 9:
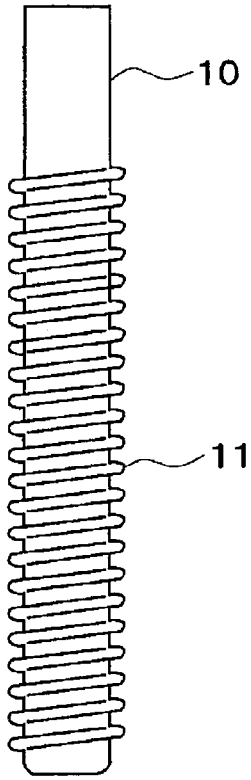
FIG. 9 is a side view to show a tube 10 in a fifth embodiment.

As shown in FIG. 9, the fins 11 of the present embodiment are formed by plastically working an outside surface of the tube 10 in a spiral shape. According to this, it is possible to eliminate the need for providing separate members as fins, so the fins 11 can be provided on the outside surface of the tube 10 with the number of parts reduced. Further, the fins are formed in the spiral shape, so the fins can improve a heat transfer coefficient.

Sixth Embodiment

Next, a sixth embodiment of the present embodiment will be described on the basis of FIG. 10. The sixth embodiment is different from the first embodiment described above in the construction of the fin 11.

Figure 10:
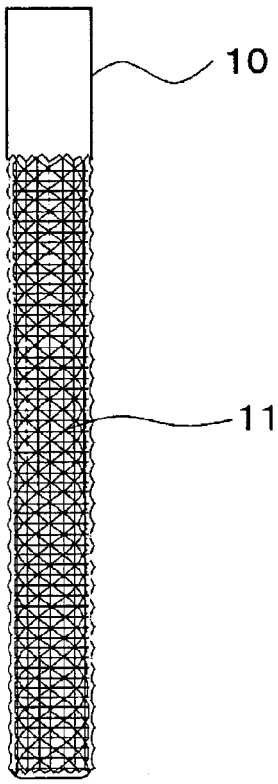
FIG. 10 is a side view to show a tube 10 in a sixth embodiment.

As shown in FIG. 10, the fins 11 of the present embodiment are formed by knurling the outside surface of the tube 10. According to this, it is possible to eliminate the need for providing separate members as fins, so the fins 11 can be provided on the outside surface of the tube 10 with the number of parts reduced. Further, the fins 11 are formed by knurling, so the fins can improve the heat transfer coefficient.

Seventh Embodiment

Next, a seventh embodiment of the present embodiment will be described on the basis of FIG. 11. The seventh embodiment is different from the first embodiment described above in the construction of the tube 10 and the fin 11.

Figure 11:
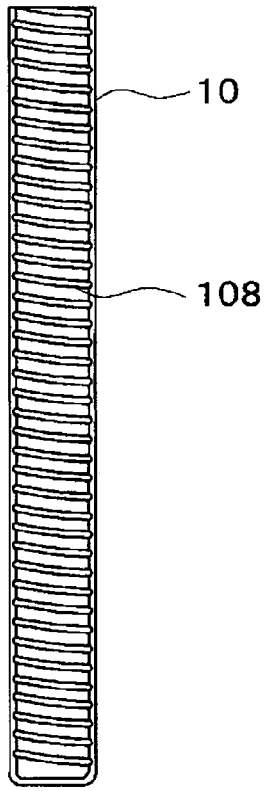
FIG. 11 is a side view to show a tube 10 in a seventh embodiment.

As shown in FIG. 11, the tube 10 of the present embodiment has a spiral groove part 108 formed on the inside surface thereof. The groove part 108 functions as a wick for sucking the liquid working fluid stored in the storing part 3 by a capillary force and for supplying the liquid working fluid to the tube 10.

According to the present embodiment, without providing a wick which is a part separate from the tube 10, it is possible to suck the liquid working fluid stored in the storing part 3 by the capillary force and to supply the liquid working fluid to the tube 10. For this reason, it is possible to reliably supply the working fluid to the tube 10 from the storing part 3 with the number of parts reduced.

Eighth Embodiment

Next, an eighth embodiment of the present embodiment will be described on the basis of FIG. 12 to FIG. 14. The eighth embodiment is different from the first embodiment described above in that the amount of working fluid (volume of working fluid) enclosed in the exhaust heat recovery device is specified.

The valve 5 of the present embodiment is constructed in such a way that when the temperature of the working fluid flowing through the working fluid passage 513 which makes the condensing part 2 communicate with the storing part 3 becomes not less than a predetermined standard temperature, the condensed working fluid passage 513 is closed.

Specifically, as is the case with the first embodiment, a mechanically operated valve which senses the pressure of the working fluid enclosed therein to thereby operate the diaphragm 54 can be employed as the valve 5. The relationship between the temperature and the pressure of the working fluid is always 1 to 1, so when the pressure of the working fluid is sensed, the temperature of the working fluid can be indirectly sensed. In this regard, it is also recommended to employ a working fluid temperature response valve constructed of a mechanical mechanism in which a valve body 53 is displaced by a thermo-wax (temperature sensing member) whose volume is changed by the temperature to thereby open or close the working fluid passage 513.

Here, it is assumed as follows: a heating-part heat transfer area that is the total sum of heat transfer areas between the exhaust gas and the working fluid in the heating part 1 is $F_g$; a heating-part volume that is the total sum of the volumes of parts in which the working fluid flows (total sum of the volumes of the plurality of tubes 10) in the heating part 1 is $V_g$; a heat transfer coefficient of the exhaust gas is $\alpha_g$; a condensing-part heat transfer area that is the total sum of heat transfer areas between the cooling water and the working fluid in the condensing part 2 is $F_w$, a condensing-part volume that is the volume of a part in which the working fluid flows in the condensing part 2 is $V_w$; a heat transfer coefficient of the cooling water is $\alpha_w$; and the volume of the storing part 3 is $V_c$.

Figure 12:
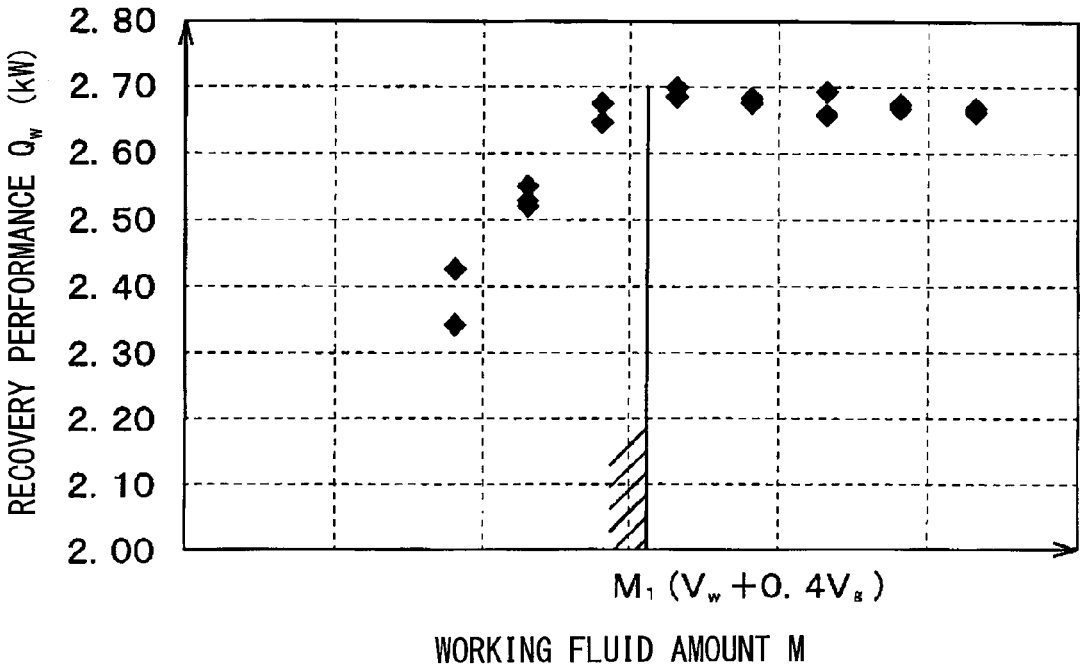
FIG. 12 is a characteristic diagram to show a relationship between the enclosed amount of a working fluid in an eighth embodiment.

As shown in FIG. 12, when the enclosed amount of the working fluid is smaller than $V_w+0.4\ V_g$, that is, the total volume of the condensing-part volume $V_w$ and 40% of the heating-part volume $V_g$, an exhaust heat recovery performance $Q_w$ is decreased. For this reason, in the present embodiment, the lower limit value $M_1$ of the enclosed amount of the working fluid is set in such a way as to satisfy the relationship shown by the following mathematical formula 1.

$$M_1=V_w+0.4V_g \quad \text{(Mathematical formula 1)}$$

Here, in exhaust heat recovery devices of various specifications in which a ratio of a boiling performance ($\alpha_g F_g$) of the heating part 1 to a condensing performance ($\alpha_w F_w$) of the condensing part 2 is different from each other, the relationship between a maximum value Pr_max of an internal pressure and the enclosed amount M of the working fluid of the exhaust heat recovery device when the exhaust heat recovery device is mounted in the vehicle was calculated by an experiment. The result of the experiment will be shown in FIG. 13.

Here, the exhaust heat recovery device of the present embodiment is constructed of stainless steel. The pressure resistant strength of the stainless steel is approximately 500 kPa, so a working fluid volume $M_2$ in which the maximum value Pr_max of the internal pressure becomes 500 kPa was found in each of the exhaust heat recovery devices. If a working fluid amount enclosed in each of the exhaust heat recovery devices is not more than $M_2$, the internal pressure of the exhaust heat recovery device is not more than 500 kPa.

Figure 13:
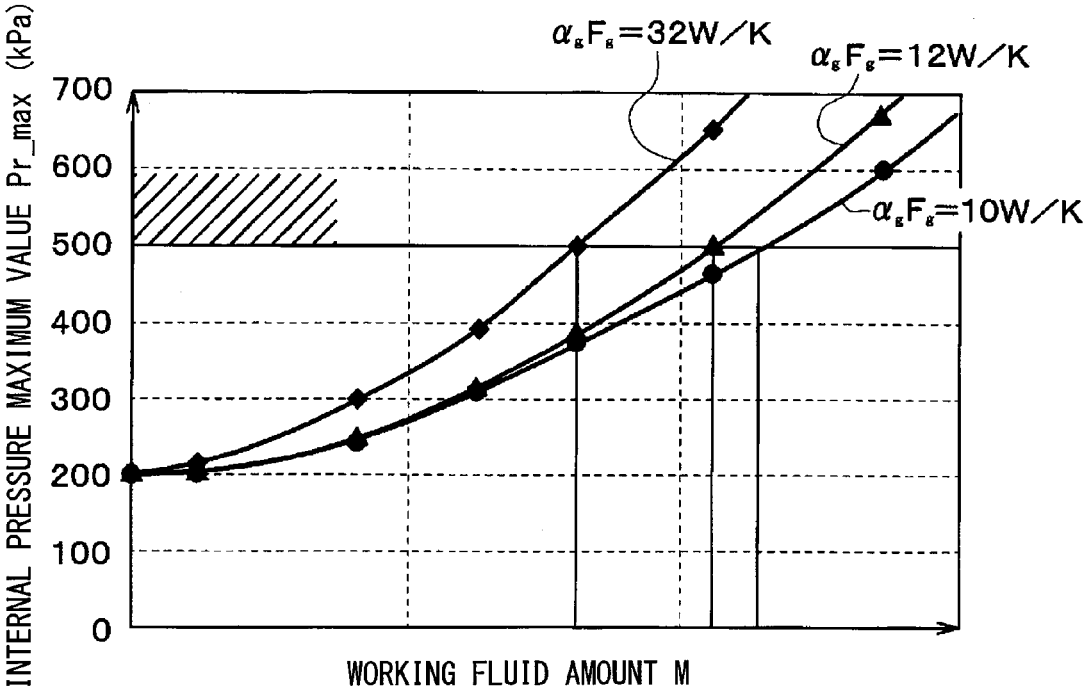
FIG. 13 is a characteristic diagram to show a relationship between the enclosed amount of the working fluid and a maximum value of an internal pressure in an eighth embodiment.
Figure 14:
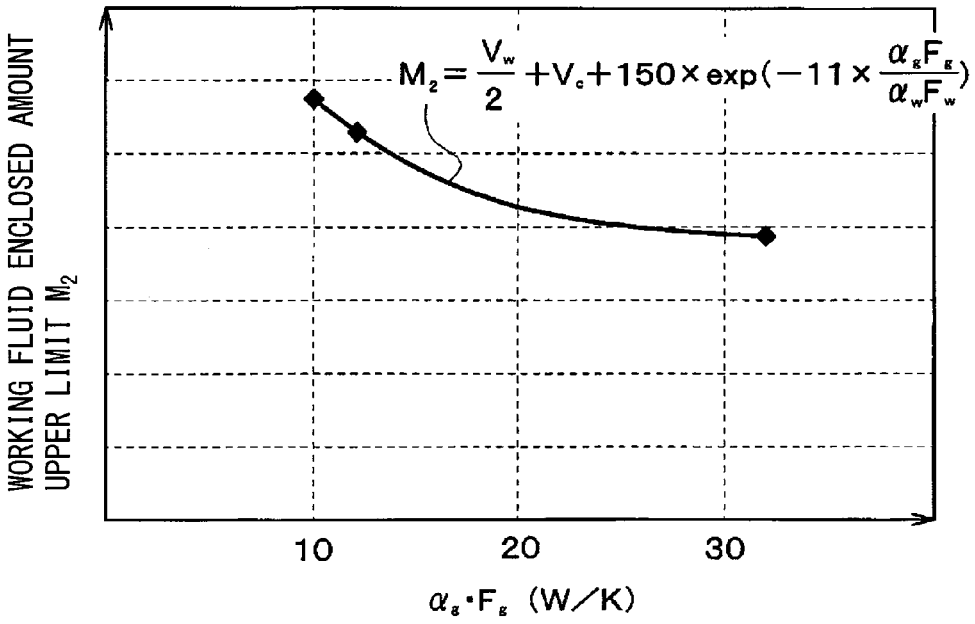
FIG. 14 is a characteristic diagram to show a relationship between a boiling performance of a heating part and an upper limit value of the enclosed amount of the working fluid in the eighth embodiment.

The relationship between the boiling performance ($\alpha_g F_g$) of the heating part 1 and the working fluid amount $M_2$ found from FIG. 13 will be shown in FIG. 14. An approximating equation passing plotted points shown in FIG. 14 is shown by $$M_2=V_w/2+V_c+150\exp(-11\times\alpha_g F_g/\alpha_w F_w)$$

For this reason, in the present embodiment, an upper limit value $M_2$ of the enclosed amount of the working fluid is set in such a way as to satisfy the relationship shown by the following mathematical formula 2.

$$M_2=V_w/2+V_c+150\exp(-11\times\alpha_g F_g/\alpha_w F_w) \quad \text{(Mathematical formula 2)}$$

As described above, when the lower limit value $M_1$ of the volume of the working fluid enclosed in the exhaust heat recovery device is set in such a way as to satisfy the relationship shown by the mathematical formula 1 described above, the exhaust heat recovery performance $Q_w$ can be secured.

Further, when an upper limit value $M_2$ of the volume of the working fluid enclosed in the exhaust heat recovery device is set in such a way as to satisfy the relationship shown by the mathematical formula 2 described above, even if the vehicle is brought into any state (is accelerated or changed in speed), a maximum value of variation in the internal pressure can be control to a value not more than 500 kPa. Hence, the pressure resistance of the exhaust heat recovery device can be secured.

As described above, the enclosed amount of the working fluid specified in the present embodiment is determined so as to restrict the internal pressure from being abnormally increased. For this reason, the mechanically operated valve which senses the pressure of the working fluid enclosed therein to thereby operate the diaphragm 54 can be employed as the valve 5 in terms of response.

Ninth Embodiment

Next, a ninth embodiment of the present embodiment will be described on the basis of FIG. 15~FIG. 19. The ninth embodiment is different from the first embodiment described above in the shape of the cooling water pipe 21.

Figure 15:
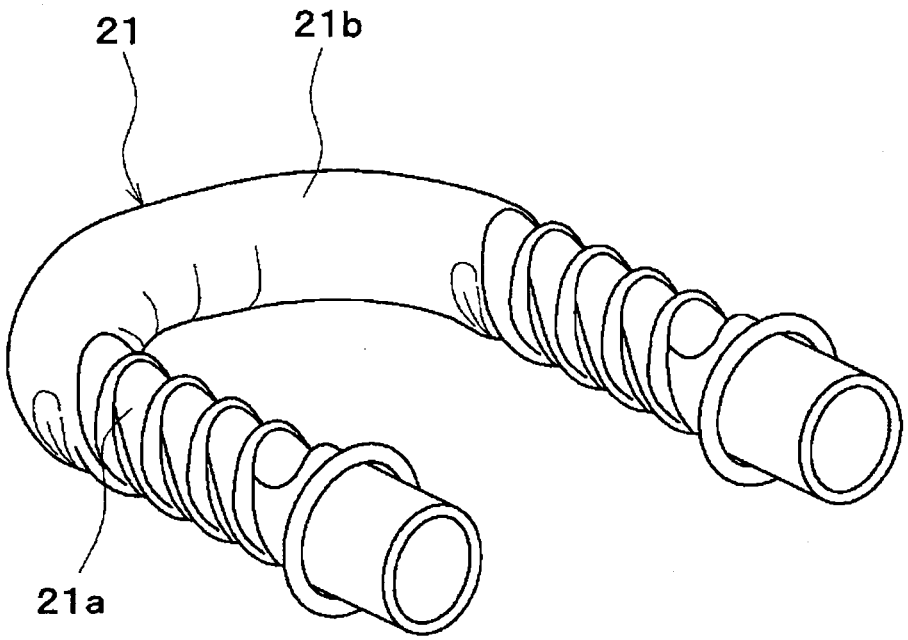
FIG. 15 is a perspective view to show a cooling water pipe in a ninth embodiment.

As shown in FIG. 15, the cooling water pipe 21 of the present embodiment has a spiral groove part 21*a* formed on the surface thereof. In the present embodiment, the groove part 21*a* is formed on a portion other than a bent portion 21*b* in which a cooling water passage is bent in the cooling water pipe 21. In the present embodiment, a pipe having an outer diameter of 10 mm or more to 30 mm or less is used as the cooling water pipe 21.

In this way, when the cooling water pipe 21 has the spiral groove part 21*a* formed on the surface thereof, the condensing performance can be improved without increasing a space in which the cooling water pipe 21 is mounted.

Figure 16:
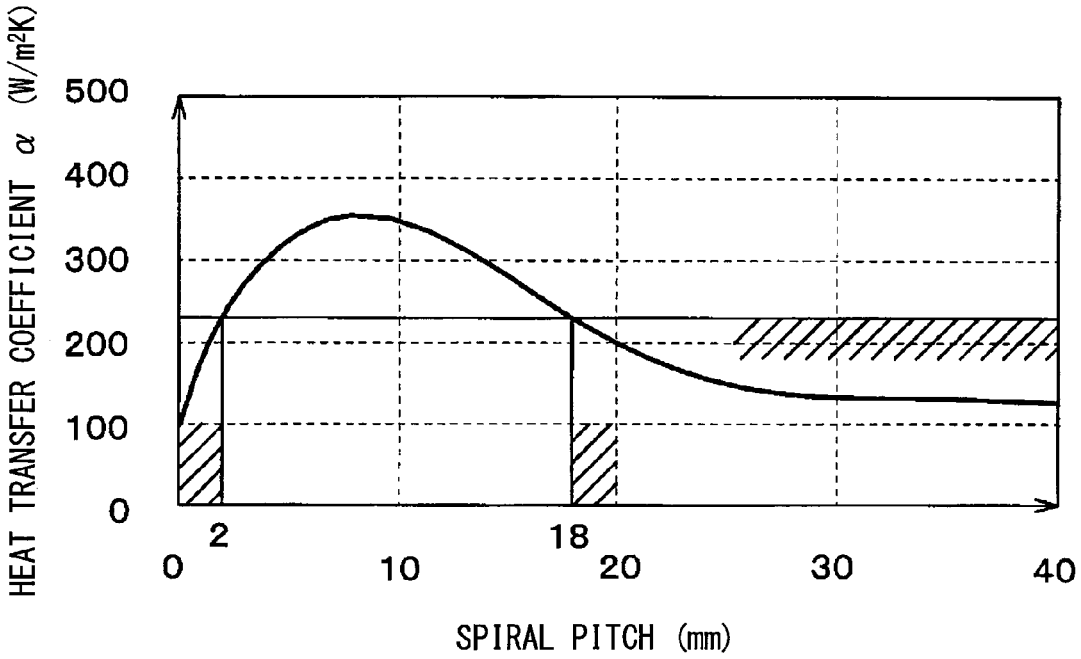
FIG. 16 is a characteristic diagram to show a relationship between a pitch of a groove part and a heat transfer coefficient in the ninth embodiment.
Figure 17:
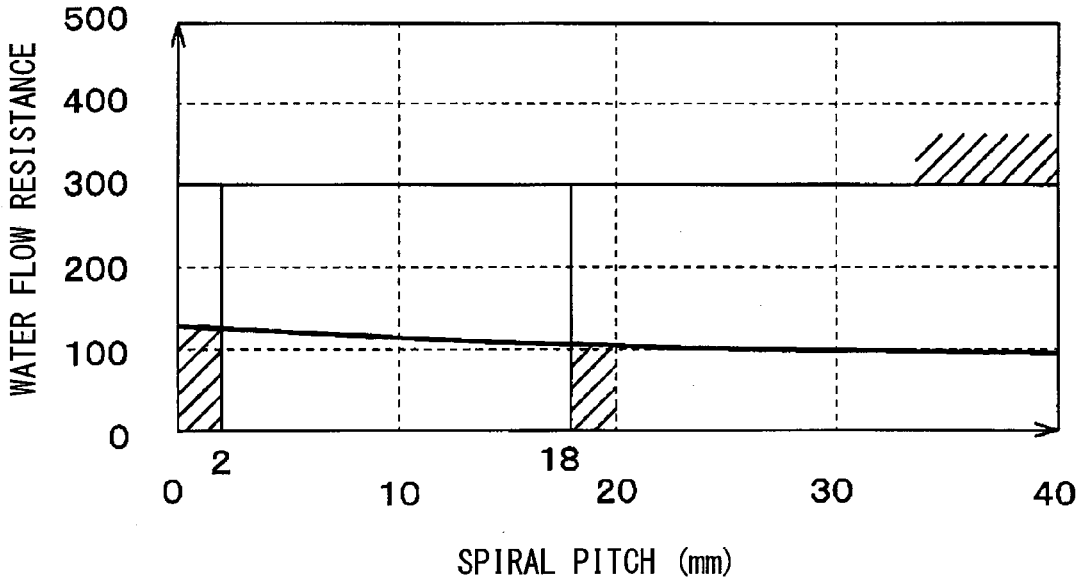
FIG. 17 is a characteristic diagram to show a relationship between the pitch of the groove part and a water flow resistance in the ninth embodiment.

By the way, when the spiral pitch of the groove part 21*a* is set at 2 mm or more to 18 mm or less, as shown in FIG. 16, a heat transfer coefficient $\alpha$ in the cooling water pipe 21 can be made larger than 200 $W/m^2K$, so the heat transfer coefficient $\alpha$ can be improved. At this time, as shown in FIG. 17, in the case where the spiral pitch of the groove part 21*a* is set at 2 mm or more to 18 mm or less, the water flow resistance of the cooling water pipe 21 can be made 300 or less, that is, the water flow resistance of the cooling water pipe 21 can be reduced.

Hence, when the spiral pitch of the groove part 21*a* is set at 2 mm or more to 18 mm or less, the heat transfer coefficient $\alpha$ in the cooling water pipe 21 can be improved and the water flow resistance of the cooling pipe 21 can be reduced. In this way, the performance of the condensing part 2 can be reliably improved.

Figure 18:
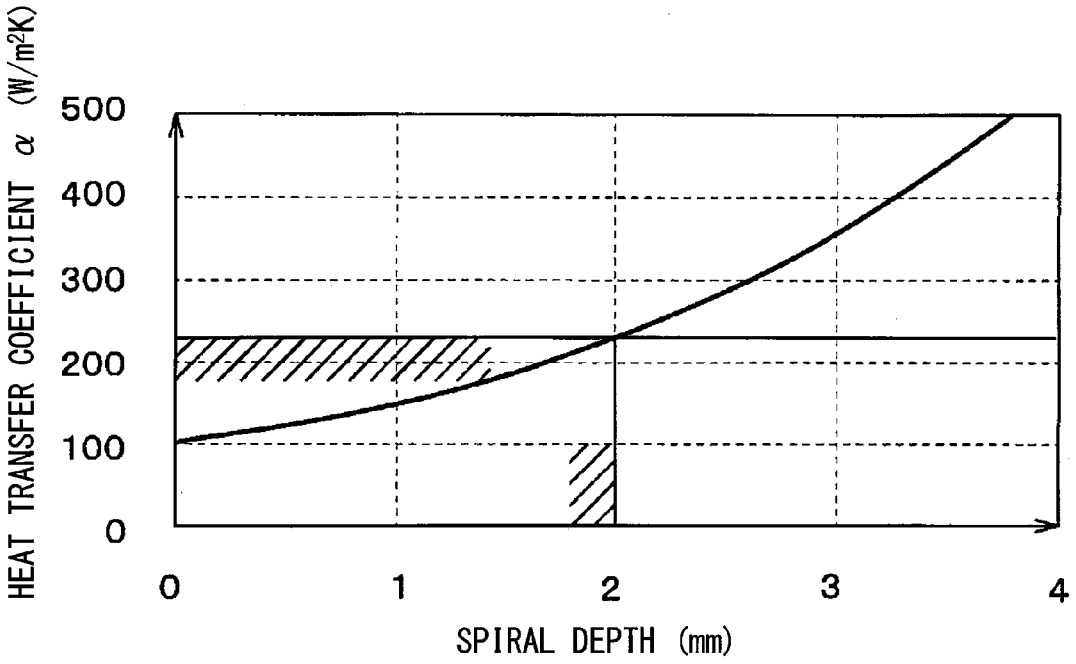
FIG. 18 is a characteristic diagram to show a relationship between a depth of the groove part and a heat transfer coefficient in the ninth embodiment.

Further, as shown in FIG. 18, when the depth of the groove part 21*a* is set at 2.0 mm or more, the heat transfer coefficient $\alpha$ in the cooling water pipe 21 can be made larger than 200 $W/m^2K$ and hence the heat transfer coefficient $\alpha$ can be improved.

Figure 19:
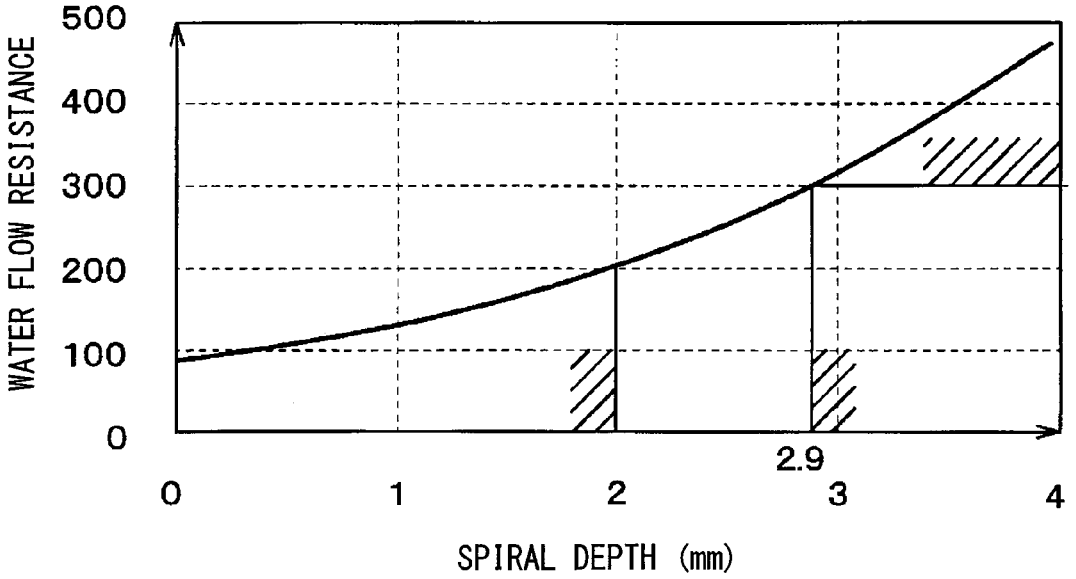
FIG. 19 is a characteristic diagram to show a relationship between the depth of the groove part and the water flow resistance in the ninth embodiment.

On the other hand, as shown in FIG. 19, as the depth of the groove part 21*a* is larger, the water flow resistance of the cooing water pipe 21 becomes larger. Here, when the depth of the groove part 21*a* is set at 2.9 mm or less, the water flow resistance of the cooing water pipe 21 can be made 300 or less, so the water flow resistance of the cooing water pipe 21 can be reduced.

Hence, when the depth of the groove part 21*a* is set at 2.0 mm or more to 2.9 mm or less, the heat transfer coefficient $\alpha$ in the cooling water pipe 21 can be improved and the water flow resistance of the cooing water pipe 21 can be reduced. In this way, the performance of the condensing part 2 can be surely improved.

The present disclosure is not limited to the embodiments described above but can be variously modified in the following manner within a scope not departing from the gist of the present disclosure.

(1) In the embodiments described above has been described an example in which the wick 31 is employed as the condensed liquid holding part. However, it is not limited to this but, for example, when a groove part is formed on the tube joint face 410 of the core plate 41, the groove part formed on the tube joint face 410 can function as the condensed liquid holding part.

(2) In the present embodiments described above has been described an example in which the exhaust heat recovery device is constructed of the chrome-based stainless steel, but a material constructing the exhaust heat recovery device is not limited to the this. For example, if there is any other material which reacts with the water of the working fluid to thereby generate hydrogen when it is heated, the exhaust heat recovery device may be constructed of the material.

(3) In the embodiment described above has been described an example in which the mesh 57 is arranged in the bypass hole 56 of the valve 5. However, it is not limited to this, but the bypass hole 56 of the valve 5 does not need to be provided with the mesh 57.

(4) In the embodiments described above (except for the fourth embodiment) has been described an example in which the hydrogen removing device 6 is formed integrally with the tank part 4, that is, the partition wall part 61 is provided in the tank part 4 to thereby form the hydrogen gas introduction passage 62. However, it is not limited to this but the hydrogen removing device 6 may be constructed as a part separate from the tank part 4 to thereby introduce the hydrogen gas from the upper end portion of the condensing part 2 of the tank part 4.

(5) In the embodiments described above has been described an example in which the copper oxide (II) is employed as the metal oxide arranged in the hydrogen removing device 6. However, it is not limited to this but other metal oxide may be employed.

(6) In the embodiments described above (except for the fifth embodiment and the sixth embodiment) has been described an example in which the tube 10 is formed in the shape of the hollow cylinder having the closed end and in which the corner portion formed of the bottom portion 101 and the side face portion 102 of the tube 10 is formed in the shape of the circular arc protruding to the outside of the tube 10. However, the shape of the tube 10 is not limited to this. For example, the corner portion formed of the bottom portion 101 and the side face portion 102 of the tube 10 may be formed in a right angle or the tube 10 may be formed in the other shape of such as a hollow ellipsoidal cylinder having a closed end.

(7) In the embodiments described above has been described an example in which the fin 11 is formed in the shape of the umbrella. However, it is not limited to this but, for example, the fin 11 may be formed in the shape of a flat plate.

(8) In the embodiments described above (except for the seventh embodiment) has been described an example in which the wick 103 is arranged in the tube 10. However, it is not limited to this but the wick 103 does not need to be arranged in the tube 10. Further, a wick made of a metal mesh may be arranged on the upper end portion of the tube 10 in such a way as to connect the wick 103 in the tube 10 to the wick 31 on the core plate 41.

(9) In the embodiments described above has been described an example in which the heat guard 7 is provided between the heating part 1 and the storing part 3. However, it is not limited to this but the heat guard 7 does not need to be provided.

(10) In the embodiments described above has been described an example of the construction in which the heating through hole 712 and the tube through hole 711 are formed in the heat guard 7 to thereby make the exhaust gas flow into the heat guard space 74. However, it is not limited to this but the heat guard 7 may be constructed in such a way that the exhaust gas does not flow into the heat guard space 74.

(11) In the embodiments described above has been described an example in which the flange 512 is provided on the upper end portion of the base part 51 in the valve 5. However, it is not limited to this but the valve 5 does not need to be provided with the flange 512.

(12) In the eighth embodiment described above has been described an example in which the working fluid temperature response valve of a mechanical type is employed as the valve 5. However, the valve 5 is not limited to this but, for example, an electromagnetic valve whose operation is controlled on the basis of a control voltage outputted from a control device may be employed as the valve 5. In this case, the exhaust heat recovery device is provided with a temperature sensor for sensing the temperature of the working fluid. Then, the control device controls the operation of the electromagnetic valve on the basis of the temperature of the working fluid sensed by the temperature sensor.

(13) In the embodiments described above has been described an example in which the wick made of the metal mesh formed in the shape of a mesh is employed as the wick 103. However, it is not limited to this but a coil wick formed in the shape of a coil (spiral) may be used as the wick 103.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. An exhaust heat recovery device comprising:

a heating part that exchanges heat between heating fluid and working fluid, which is enclosed in the heating part and is capable of being evaporated and condensed, so as to evaporate the working fluid, the heating part includes a tube through which the working fluid flows;

an upper end portion of the tube in a vertical direction opens; and a lower end portion of the tube in the vertical direction is closed;

a condensing part that exchanges heat between the working fluid evaporated by the heating part and heated fluid so as to condense the working fluid; and a storing part located outside of the tube is provided on an upper side of the heating part in the vertical direction and stores the working fluid condensed by the condensing part, the storing part includes a tube joint part that is joined to the upper end portion of the tube.

2. An exhaust heat recovery device comprising:

a heating part that exchanges heat between heating fluid and working fluid, which is enclosed in the heating part and is capable of being evaporated and condensed, so as to evaporate the working fluid, the heating part includes a tube through which the working fluid flows;

an upper end portion of the tube in a vertical direction opens; and a lower end portion of the tube in the vertical direction is closed;

a condensing part that exchanges heat between the working fluid evaporated by the heating part and heated fluid so as to condense the working fluid;

a storing part located outside of the tube is provided on an upper side of the heating part in the vertical direction and stores the working fluid condensed by the condensing part, the storing part includes:

a tube joint part that is joined to the upper end portion of the tube;

a condensed working fluid passage that introduces the working fluid condensed by the condensing part to the storing part; and a valve that opens or closes the condensed working fluid passage and is configured to close the condensed working fluid passage when temperature of the working fluid flowing through the condensed working fluid passage reaches a predetermined standard temperature or higher.

3. The exhaust heat recovery device according to claim 2, wherein the upper end portion of the tube is arranged on a vertically upper side of a lower end surface of the tube joint part in the vertical direction.

4. The exhaust heat recovery device according to claim 2, further comprising:

a bypass passage through which the working fluid condensed by the condensing part flows to bypass the valve into the storing part.

5. The exhaust heat recovery device according to claim 2, wherein:

the tube includes a fin that accelerates a heat transfer between the heating fluid and the working fluid; and the fin is formed by plastically working an outside surface of the tube into a spiral shape.

6. The exhaust heat recovery device according to claim 2, wherein:

the tube includes a fin that accelerates a heat transfer between the heating fluid and the working fluid; and the fin is formed by knurling an outside surface of the tube.

7. The exhaust heat recovery device according to claim 2, wherein:

the tube includes a groove part that is formed on an inside surface of the tube; and the groove part absorbs the working fluid stored in the storing part by capillary force to supply the working fluid to the tube.

8. The exhaust heat recovery device according to claim 2, further comprising a heat conduction limiting member between the heating part and the storing part, wherein the heat conduction limiting member limits a heat conduction from the heating fluid for the heating part to the working fluid in the storing part.

9. The exhaust heat recovery device according to claim 2, wherein:

the tube is formed in a shape of a hollow cylinder having a closed end, and includes a side surface portion, a bottom portion, and a corner portion between the side surface portion and the bottom portion; and the corner portion is formed in a shape of a circular arc.

10. The exhaust heat recovery device according to claim 2, wherein $M_1$, which is a lower limit value of a volume of the enclosed working fluid, and $M_2$, which is an upper limit value of the volume of the enclosed working fluid are set to satisfy a relationship expressed by the following first mathematical formula and second mathematical formula:

$$M_1=V_w+0.4V_g; \quad \text{(first mathematical formula)}$$

and $$M_2=V_w/2+V_c+150\exp(-11\times\alpha_g F_g/\alpha_w F_w) \quad \text{(second mathematical formula)}$$

where:

$F_g$ is a total sum of a heat transfer area between the heating fluid and the working fluid in the heating part;

$V_g$ is a volume of a part of the heating part through which the working fluid flows;

$\alpha_g$ is a heat transfer coefficient of the heating fluid;

$F_w$ is a total sum of a heat transfer area between the heated fluid and the working fluid in the condensing part;

$V_w$ is a volume of a part of the condensing part in which the working fluid flows;

$\alpha_w$ is a heat transfer coefficient of the heated fluid; and $V_c$ is a volume of the storing part.

11. The exhaust heat recovery device according to claim 2, wherein the storing part includes a condensed liquid holding part that holds the working fluid condensed by the condensing part.

12. The exhaust heat recovery device according to claim 2, wherein:

the tube is one of a plurality of tubes;

the plurality of tubes includes fins respectively;

the fins accelerate a heat conduction between the heating fluid and the working fluid; and the fins are not connected to each other.

13. The exhaust heat recovery device according to claim 12, wherein each of the fins includes a curved surface having a shape of a circular arc projecting toward a lower side in the vertical direction.

14. The exhaust heat recovery device according to claim 2, wherein:

the working fluid is water; and the heating part, the condensing part, and the storing part are configured from a material that reacts with the working fluid to generate hydrogen gas when heated, the exhaust heat recovery device further comprising:

a heating fluid passage through which the heating fluid flows; and a metal oxide receiving part in which metal oxide is enclosed and into which the hydrogen gas flows, wherein:

the metal oxide receiving part communicates with the condensing part; and at least a part of the metal oxide receiving part is arranged in the heating fluid passage.

15. The exhaust heat recovery device according to claim 14, further comprising a heat conduction limiting member between the heating part and the storing part, wherein:

the heat conduction limiting member limits a heat conduction from the heating fluid for the heating part to the working fluid in the storing part; and the metal oxide receiving part is connected to the tube joint part and is arranged between the tube joint part and the heat conduction limiting member.

16. The exhaust heat recovery device according to claim 14, wherein a part of the metal oxide receiving part is in contact with the heating fluid passage and another part of the metal oxide receiving part is in contact with outside air.

17. The exhaust heat recovery device according to claim 14, further comprising a hydrogen gas introduction passage that is connected to an upper side of the condensing part in the vertical direction and introduces the hydrogen gas into the metal oxide receiving part.

18. An exhaust heat recovery device comprising:

a heating part that exchanges heat between heating fluid and working fluid, which is enclosed in the heating part and is capable of being evaporated and condensed, so as to evaporate the working fluid, the heating part includes a tube through which the working fluid flows;

an upper end portion of the tube in a vertical direction opens; and a lower end portion of the tube in the vertical direction is closed;

a condensing part that exchanges heat between the working fluid evaporated by the heating part and heated fluid so as to condense the working fluid;

a storing part that is provided on an upper side of the heating part in the vertical direction and stores the working fluid condensed by the condensing part, the storing part includes:

a tube joint part that is joined to the upper end portion of the tube;

a condensed working fluid passage that introduces the working fluid condensed by the condensing part to the storing part;

a valve that opens or closes the condensed working fluid passage and is configured to close the condensed working fluid passage when temperature of the working fluid flowing through the condensed working fluid passage reaches a predetermined standard temperature or higher; and a bypass passage through which the working fluid condensed by the condensing part flows to bypass the valve into the storing part.

19. The exhaust heat recovery device according to claim 18, wherein:

the working fluid is water; and the heating part, the condensing part, and the storing part are configured from a material that reacts with the working fluid to generate hydrogen gas when heated, the exhaust heat recovery device further comprising:

a heating fluid passage through which the heating fluid flows; and a metal oxide receiving part in which metal oxide is enclosed and into which the hydrogen gas flows, wherein:

the metal oxide receiving part communicates with the condensing part; and at least a part of the metal oxide receiving part is arranged in the heating fluid passage.

20. The exhaust heat recovery device according to claim 19, further comprising a heat conduction limiting member between the heating part and the storing part, wherein:

the heat conduction limiting member limits a heat conduction from the heating fluid for the heating part to the working fluid in the storing part; and the metal oxide receiving part is connected to the tube joint part and is arranged between the tube joint part and the heat conduction limiting member.

* * * * *